United States Patent [19]

Culp

[11] Patent Number: 4,817,340

[45] Date of Patent: Apr. 4, 1989

[54] TOOL AND METHOD FOR REPAIRING FLAT BEARING SURFACES

[76] Inventor: Gary Culp, 1200 E. Airport, Hermiston, Oreg. 97838

[21] Appl. No.: 171,674

[22] Filed: Mar. 21, 1988

[51] Int. Cl.[4] ..... B24B 15/00

[52] U.S. Cl. ..... 51/241 S; 51/281 R

[58] Field of Search ..... 51/241 R, 241 S, 241 VS, 51/245, 281 R, 281 P

[56] References Cited

U.S. PATENT DOCUMENTS 3,999,331 12/1976 Trujillo ..... 51/241 S 4,449,330 5/1984 McCarthy et al. ..... 51/241 S

FOREIGN PATENT DOCUMENTS 708847 5/1954 United Kingdom ..... 51/241 S

*Primary Examiner*—Roscoe V. Parker

*Attorney, Agent, or Firm*—Chernoff, Vilhauer, McClung & Stenzel

[57] ABSTRACT

A tool and method for truing and reconditioning flat bearing surfaces without damaging adjacent cylindrical bearing seats is disclosed. The tool employs a journaling member which precisely positions an arbor and grinding disc assembly axially for engagement of the face of the disc with the flat bearing surface. The abrasive disc has an outer periphery which is radially inward of the ends of an adjoining journaling member end so as to prevent contact between the abrasive disc and the cylindrical bearing seats. An elongate drive rod provides a connection between a rotary drive means and the arbor in applications involving limited access to the tool when installed.

6 Claims, 1 Drawing Sheet

TOOL AND METHOD FOR REPAIRING FLAT BEARING SURFACES

BACKGROUND OF THE INVENTION

The present invention is directed to a tool for repairing recesses and warpage in difficult to reach flat surfaces of machinery housings or casings. The tool is particularly suited for use in applications involving the truing and repair of the opposed faces of axial bearing seats.

Machinery housings and casings frequently include a pair of opposed bearing seats for supporting or restraining moving elements. Vehicle rear-end differential housings, for example, typically include a pair of opposed bearing seats, each seat when assembled having a stationary bearing cup positioned therein. When a bearing cup, bushing or similar stationary component in contact with the moving element becomes loose within the bearing seat, it can spin or otherwise move within the seat creating recesses in the seat's axial face. Such frictional wear can also result in warpage requiring truing up of the axial seat faces. It is frequently difficult or impossible to transport or to position the housing or casing for repair of such damage on a lathe or other machine tool. The axle tubes of a vehicle differential housing, for example, must be removed as a preliminary step to using a lathe for such a repair. Such procedure is time consuming and costly.

Other prior art tools for reconditioning flat casing surfaces generally use an abrasive means secured to a rotatable shaft, as shown, for example, in McCarthy et al., U.S. Pat. No. 4,449,330. Such tools, however, are unsuited for many applications involving the closer tolerances associated with damaged flat surfaces having contiguous cooperating structure. Such prior art tools are unsatisfactory, for example, in the repair of the faces of axial bearing seats, where it is desired to avoid grinding the surrounding radial bearing seats while at the same time grinding the entire enclosed damaged flat surface. Further, the alignment of such prior art tools depends exclusively on substantially direct engagement of a relatively narrow rotatable shaft with the housing. Misalignment of the relatively narrow shaft of McCarthy, et al. within the casing, for example, though in many cases suitable for the removal of corrosion, can result in unacceptable error in the positioning of the grinding surface in applications requiring closer tolerances.

SUMMARY OF THE INVENTION

The present invention is directed to a tool which solves the aforementioned deficiencies of the prior art. The need for a tool and method for repairing the faces of axial bearing seats, without also grinding the adjacent radial portion, is satisfied by employing an abrasive disk secured to an arbor mounted for rotation and limited reciprocation in a journaling member. An end of the journaling member matingly engages a bearing seat so as to accurately position the axis of rotation of the disk with respect to the flat bearing surface to be repaired. The disk has a selected diameter less than that of the end of the journaling member so as to prevent contact between the circumference of the disk and the bearing seat. An elongate drive rod may be used to engage the arbor within the journaling member for displacement along the axis of rotation so as to contact the outer face of the disk with the flat bearing surface. The drive rod detachably connects to the arbor for rotation of the arbor and attached disk. In applications requiring the truing and repair of a pair of opposed flat bearing surfaces, each end of the journaling member matingly engages a respective bearing seat for automatic alignment of the disk both in a first position and, when reversing the position of the journaling member end-for-end, in a second position to effect repair of an opposite surface.

The foregoing and other objectives, features and advantages of the present invention will be more readily understood upon consideration of the following detailed description of the invention taken in conjunction with the accompanying drawings.

DESCRIPTION OF THE PREFERRED EMBODIMENT

Figure 2:
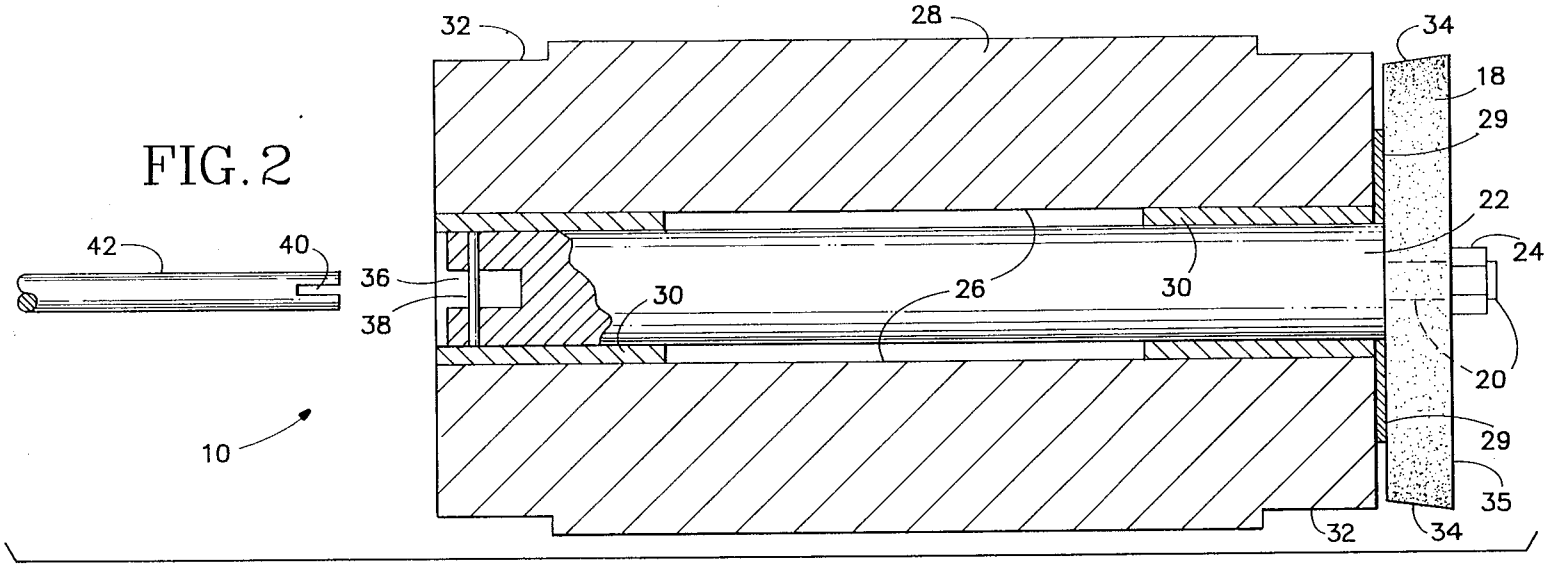
FIG. 2 is a top sectional view of the tool of FIG. 1.
Figure 1:
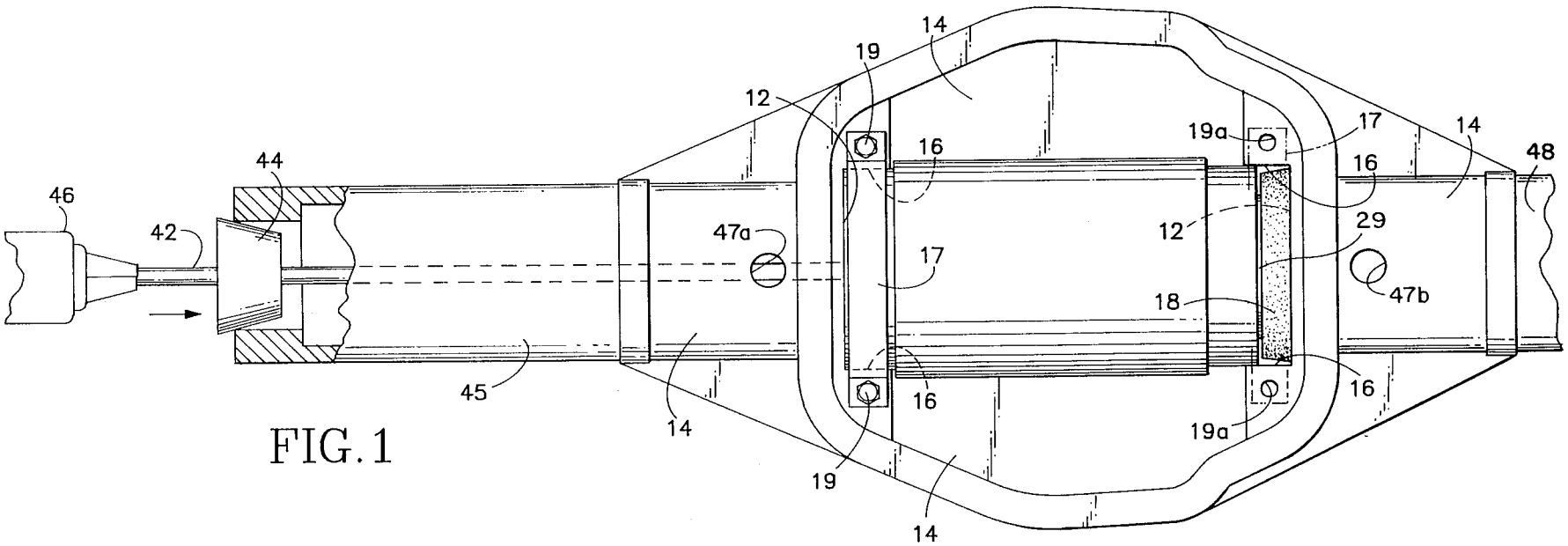
FIG. 1 is a top view, partially broken away, of a preferred embodiment of a tool for repairing flat surfaces in accordance with the present invention installed in an automobile differential housing.

Referring to the drawings, a preferred embodiment of the present invention is shown in FIGS. 1 and 2 as comprising a tool 10 for truing and reconditioning a pair of opposed flat axial bearing seat surfaces 12 in a vehicle differential housing 14, each surface 12 having respective peripheral cylindrical bearing seats 16. As seen in FIG. 1, the upper segment of each bearing seat 16 is formed by a semi-circular bracket 17 (only one of which is shown) removably secured by bolts 19 which engage respective threaded apertures 19*a* in the housing 14. A grinding stone 18, formed as a circular disk, is secured to a threaded stud 20 of arbor 22 by a nut 24. The arbor is received in an axial cylindrical bore 26 of a cylindrical journaling member 28. A nylon washer 29 prevents contact between the grinding stone 18 and the member 28. The arbor 22 has a length of approximately 1/16 inch shorter than member 28 and is engaged therein by brass or nylon bushings 30 pressed into each end of the bore so as to provide a difference of 0.0005 to 0.001 inches in diameter between each bushing opening and the arbor. The cylindrical member 28 is preferably fabricated of aluminum or alternatively of steel, stainless steel, or plastic such as a nylon. The member 28 has reduced diameter ends 32 which substantially correspond to the inside diameter of the bearing seats 16 so as to matingly engage therein. With each end 32 so positioned in a respective seat 16 as shown in FIG. 1, and the arbor journaled in the member 28, the arbor 22 and stone 18 are thereby automatically axially aligned with the bearing seats 16 and the outer face of the stone 35 is positioned for planar engagement with a flat bearing surface 12. The stone 18 is provided with inwardly tapered edges 34 and has a maximum diameter at the outer face which is 0.010 inches less than the inside diameter of bearing seat 16 and the corresponding outside diameter of the ends 32 of the journaling member. The selected stone diameter and the accurate, automatic axial alignment of the stone by the member 28 allows the face of the stone to repair substantially the entire flat axial bearing seat surface 12 so as to provide sufficient engagement with a reinstalled bearing cup without grinding the surrounding cylindrical bearing seat 16. The opposite end of the arbor 22 has an axial bore 36 with a roll pin 38 installed perpendicularly there-through for detachable engagement with a slot 40 formed in one end of drive rod 42. The drive rod, when engaged with the pin 38, is positioned and axially supported at the opposite end by an apertured, plastic truncated cone 44 slidably mounted on the drive rod 42 and removably engaging the outer opening of the differential axle tube 45 opposite the bearing seat to be repaired. The end of the drive rod 42 adjacent the cone 44 is detachably engaged by conventional means to a rotary power source, typically a conventional power tool 46.

In operation, the gear assembly or carrier within a vehicle differential housing to be repaired is removed using a typical housing spreader installed in the locating holes 47*a*, 47*b* of housing 14. Such removal normally includes disengaging bolts 19 so as to remove brackets 17. The tool 10 is then installed by placing each end 32 of journaling member 28, having its arbor 22 fully inserted therein, into a respective bearing seat 16. The brackets 17 are then securely reinstalled by reengaging the bolts 19 in their respective threaded apertures 19*a*. The end of the drive rod 42 having the slot 40 is then inserted through the differential axle tube 45, opposite the bearing seat 16 having stone 18 therein, so as to insert the end of the rod into the axial bore 36 of the arbor 22 and engage the slot 40 with the roll pin 38. The plastic cone 44 is then slid along the rod 42 until a snug engagement between it and the outer opening of the differential axle tube 45 is achieved, which engagement axially aligns the rod 42 with the arbor 22. The end of the rod protruding from the tube 45 is then removably secured to a conventional rotary power tool 46. Activation of the tool 46 rotates the drive rod which in turn rotates the arbor 22 and stone 18 by virtue of the connection of thread and arbor at pin 38. Simultaneously with the rotation of the rod 42, an axial force is applied by the power tool operator in the direction of the arrow shown in FIG. 1. Such force shifts the arbor 22 within the journaling member 28 in the same axial direction as the arrow, which movement results in the engagement of the outer face 35 of stone 18 with the flat axial surface 12. Simultaneous rotation and engagement of the stone with the surface 12 is maintained until the desired surface specifications are achieved. The opposing surface 12 can then be repaired by removing the drive rod 42 and the brackets 17, removing and reversing the position of the tool 10 end-for-end, and repeating the previously discussed connections and operating steps including, in this reverse position, reconnection of the drive rod 42 to the arbor 22 through axle tube 48.

Once both surfaces 12 are repaired the drive rod 42 and the brackets 17 are again disengaged so as to remove the tool 10 from the housing 14. Reinstallation of the gear assembly or carrier into the housing includes the addition of shim packs between the bearing cones and their mating surface so as to reestablish desired bearing axial preload. Also, the mating surfaces of the housing 14 and brackets 17 are typically filed until square to the same plane and until the desired bearing cup radial preload is restored.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A tool for truing and reconditioning a flat bearing surface having a peripheral cylindrical bearing seat extending perpendicularly from said surface, said tool comprising:

(a) a journaling member having an axis of rotation, an end, and an external surface adjacent said end for matingly engaging said cylindrical bearing seat and thereby positioning said axis of rotation at the center of said bearing seat;

(b) an arbor rotatably journaled in said journaling member so as to rotate about said axis of rotation; and (c) an abrasive circular disk affixed to said arbor so as to be rotatably driven by said arbor about said axis, said disk being positioned externally of said end of said journaling member and having an outer periphery which is radially inward of said external surface so as to prevent contact of said periphery with said cylindrical bearing seat.

2. The tool of claim 1, including an elongate drive rod having means for detachably connecting said drive rod to said arbor for rotation of said arbor.

3. The tool of claim 2 wherein said arbor includes an end opposite said end of said journaling member, said end of said arbor and said drive rod having a mating slot and pin assembly for detachably engaging each other.

4. The tool of claim 2 including detachable means for mounting said rod for rotation and reciprocation along said axis of rotation.

5. A tool for truing and reconditioning one of a pair of spaced, opposed, flat bearing surfaces having respective peripheral, cylindrical bearing seats extending coaxially and perpendicularly from said surfaces toward each other, said tool comprising:

(a) a journaling member having an axis of rotation, a pair of ends, and respective external surfaces at each of said ends for matingly engaging said cylindrical bearing seats and thereby aligning said axis of rotation coaxially with said bearing seats;

(b) an arbor rotatably journaled in said journaling member so as to rotate about said axis of rotation;

(c) an abrasive circular disk affixed to said arbor so as to be rotatably driven by said arbor about said axis, said disk being positioned externally of one of said ends of said journaling member;

(d) an elongate drive rod; and (e) means for detachably connecting said drive rod to said arbor.

6. A method for truing and reconditioning one of a pair of spaced, opposed, flat bearing surfaces having respective peripheral cylindrical bearing seats extending coaxially and perpendicularly from said surfaces toward each other, said method comprising:

(a) providing a journaling member having a pair of ends and an abrasive disk journaled at one end thereof for rotation about an axis of rotation;

(b) matingly engaging each end of said journaling member with one of said cylindrical bearing seats and thereby aligning said axis of rotation coaxially with said bearing seats;

(c) detachably engaging said disk with a rotatable elongate drive rod;

(d) rotating said drive rod and thus said disk; and (e) simultaneously with step (d), transmitting an axial force along said drive rod so as to engage said disk with one of said flat bearing surfaces.

* * * * *

UNITED STATES PATENT AND TRADEMARK OFFICE

CERTIFICATE OF CORRECTION

PATENT NO. : 4,817,340

DATED : April 4, 1989

INVENTOR(S) : Gary Culp

It is certified that error appears in the above-identified patent and that said Letters Patent is hereby corrected as shown below:

Col. 3, Line 35 Change "thread" to --the rod--.

Signed and Sealed this

Second Day of October, 1990

*Attest:*

HARRY F. MANBECK, JR.

*Attesting Officer*

*Commissioner of Patents and Trademarks*